US007296853B2

(12) United States Patent
Piretti

(10) Patent No.: US 7,296,853 B2
(45) Date of Patent: Nov. 20, 2007

(54) NESTABLE CHAIR

(75) Inventor: Giancarlo Piretti, Bologna (IT)

(73) Assignee: Pro-Cord, Bologna (IT)

( * ) Notice: Subject to any disclaimer, the term of this patent is extended or adjusted under 35 U.S.C. 154(b) by 0 days.

(21) Appl. No.: 11/558,044

(22) Filed: Nov. 9, 2006

(65) Prior Publication Data

US 2007/0120406 A1 May 31, 2007

(30) Foreign Application Priority Data

Nov. 10, 2005 (EP) ..... 05425789

(51) Int. Cl.
*A47C 3/04* (2006.01)

(52) U.S. Cl. ..... 297/239; 297/326; 297/335

(58) Field of Classification Search ..... 297/239, 297/331, 335, 325, 326
See application file for complete search history.

(56) References Cited

U.S. PATENT DOCUMENTS 6,742,839 B2 * 6/2004 Piretti ..... 297/239
6,755,468 B1 6/2004 Pan
7,147,286 B2 * 12/2006 Cesaroni et al. ..... 297/301.1

FOREIGN PATENT DOCUMENTS

| | | |
|---|---|---|
| EP | 1 300 099 | 4/2003 |
| JP | 02159216 A * | 6/1990 |
| WO | WO 03/099069 | 12/2003 |

OTHER PUBLICATIONS

EP Search Report, Application No. 05425789.4, dated Jun. 6, 2006.

* cited by examiner

*Primary Examiner*—Anthony D. Barfield
(74) *Attorney, Agent, or Firm*—Patterson & Sheridan, L.L.P.

(57) ABSTRACT

Chair comprising, a fixed base structure comprising two front legs and two rear legs mutually connected by a cross member, in which the front legs and the rear legs are mutually offset in such a way that the front legs of a first chair can be inserted between the rear legs of a second chair identical to the first, and a seat-backrest assembly borne by the support structure and rotatable around said cross member between a position of use and a position of stowage, in which in the position of stowage the seat-backrest assembly is rotated forwards relative to the position of use.

11 Claims, 7 Drawing Sheets

NESTABLE CHAIR

CROSS-REFERENCE TO RELATED APPLICATIONS

This application claims benefit of European Patent Application Number 05425789.4, filed Nov. 10, 2005, which is herein incorporated by reference.

BACKGROUND OF THE INVENTION

1. Field of the Invention

The present invention relates to a nestable chair according to the preamble of claim 1.

The chairs that are usable for conventions, conferences and similar events are usually nestable with each other so that, at the end of the event, the chairs can be stored in restricted spaces. A typical solution for nesting chairs provides the possibility of superposing the chairs in vertical direction, with each lower chair nested with respect to the chair immediately above it.

2. Description of the Related Art

Also known are chairs that can be nested together in horizontal direction, in which the front legs of a first chair can be inserted between the rear legs of a second chair, identical to the first one, when the two chairs are approached to each other in the longitudinal direction.

SUMMARY OF THE INVENTION

The object of the present invention is to provide a horizontally nestable chair with a simple and economical structure and which allows a high degree of nesting to minimise the space occupied in the stowage position.

According to the present invention, said object is achieved by a chair having the characteristics set out in claim 1.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
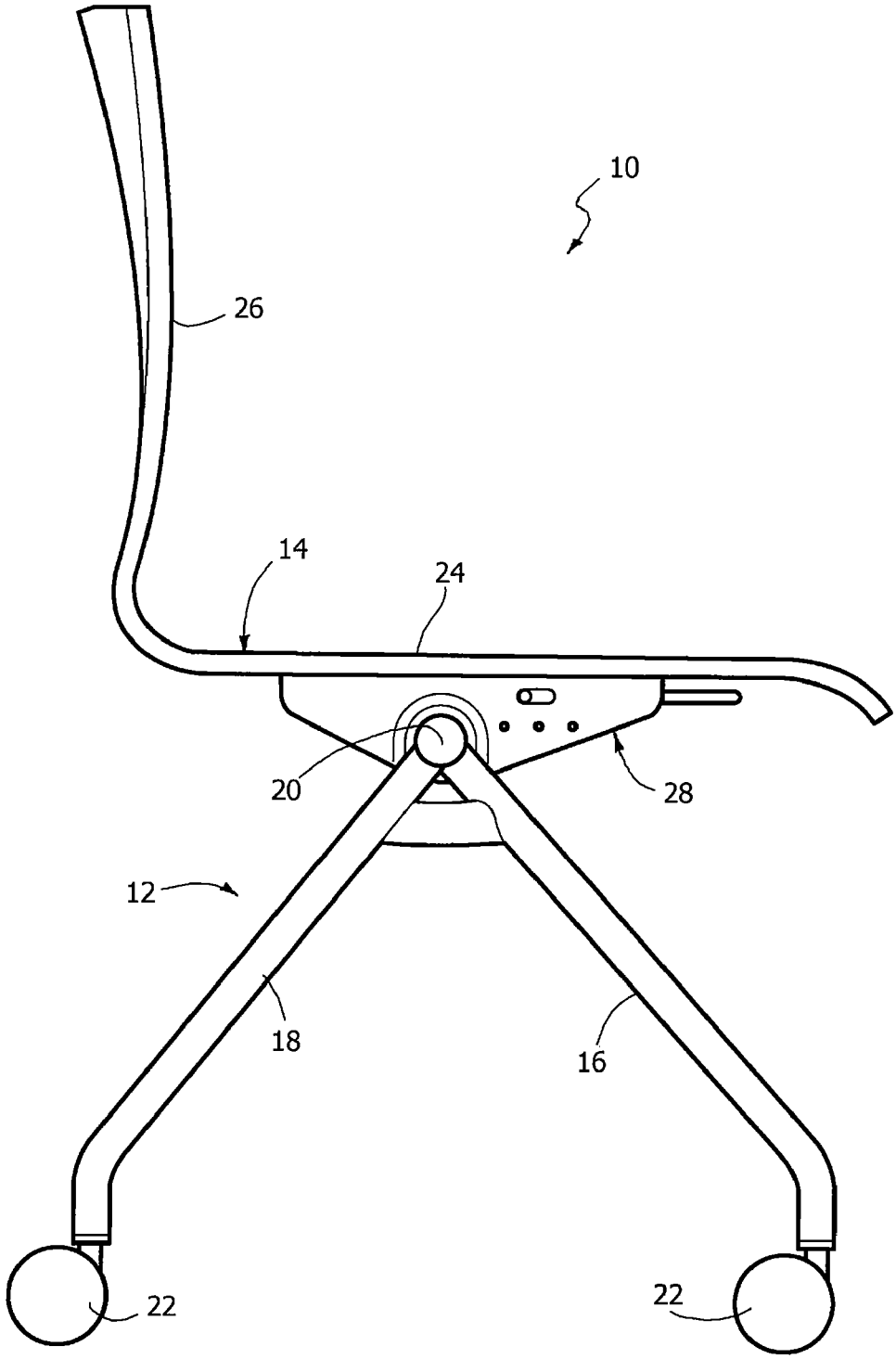
FIG. 1 is a lateral view of a chair according to the present invention.
Figure 2:
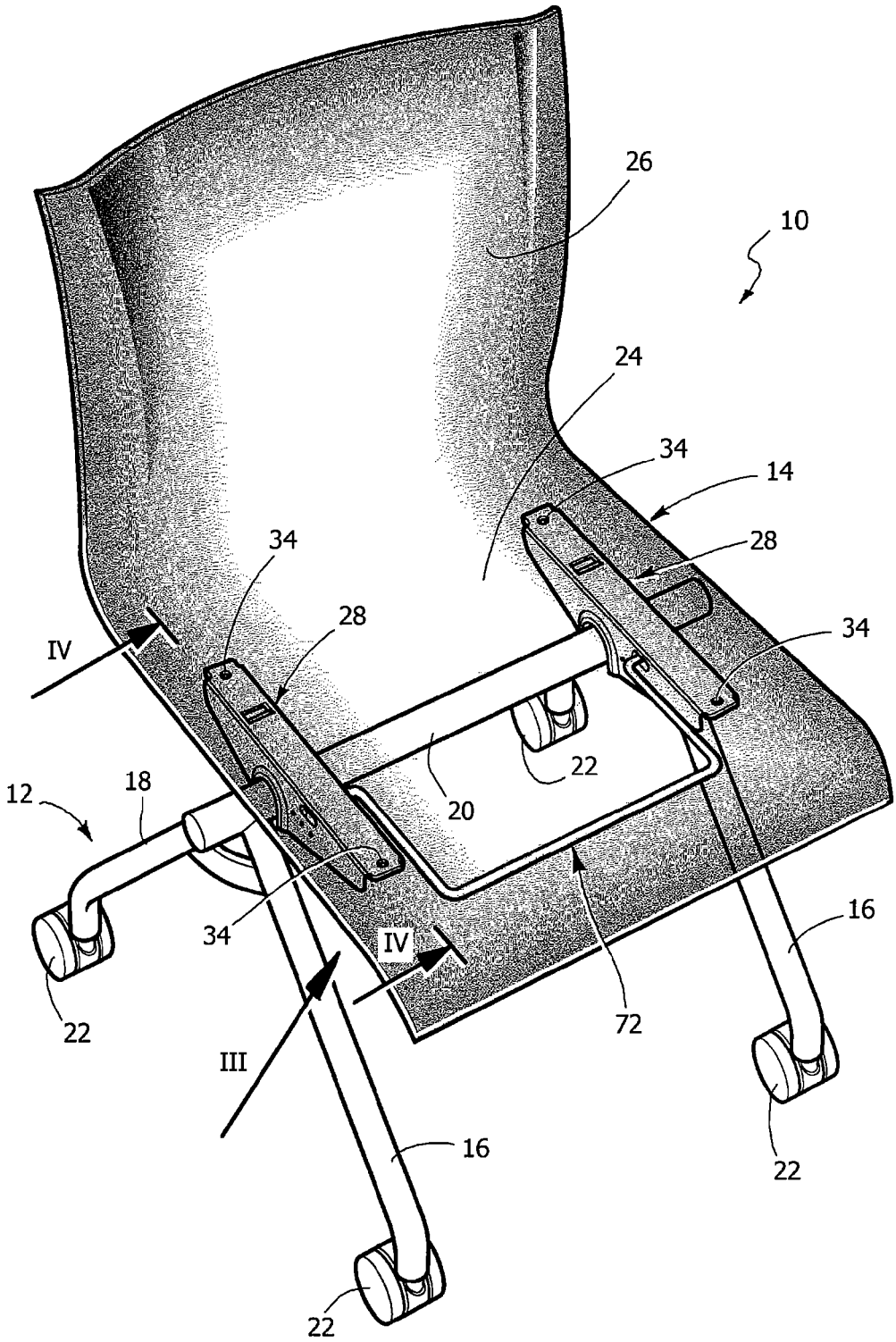
FIG. 2 is a perspective view of a chair according to the present invention with the seat-backrest assembly shown in see-through fashion.

With reference to FIGS. 1 and 2, the reference number 10 designates a chair according to the present invention. The chair 10 comprises a fixed base structure 12 bearing a seat-backrest assembly 14.

The fixed base structure 12 comprises two front legs 16, two rear legs 18 and a cross member 20 situated at the top end of the legs 16, 18. The front and rear legs 16, 18 extend downwards starting from the cross member 20 and are respectively inclined forwards and backwards relative to a vertical plane passing through the cross member 20. In the illustrated example, the legs 16, 18 and the cross member 20 are constituted by metallic tubular elements welded to each other. The legs 16, 18 are preferably provided at their lower ends with pivotable wheels 22. The longitudinal axes of the legs 16, 18 are contained in respective vertical planes, parallel to each other.

The front legs 16 and the rear legs 18 are mutually offset in order to allow the mutual nesting of the base structures 12 when two identical chairs are approached to each other horizontally in the longitudinal direction. In the illustrated example, the distance between the front legs 16 in transverse direction is less than the distance between the rear legs 18. In other words, each front leg 16 is displaced in transverse direction inwards relative to the rear leg 18 of the same side of the chair. In nested configuration, the front legs 16 of a first chair are inserted between the rear legs of a second chair.

The seat-backrest assembly 14 comprises a seat portion 24 and a backrest portion 26. In the example shown in the figures, the seat-backrest assembly 14 is constituted by a monolithic element made of plastic material, e.g. injection molded. Alternatively, the seat portion and the backrest portion 24, 26 could be two distinct elements fastened or articulated to each other. The backrest portion 26 can be fixed relative to the seat portion 24 or it can be tiltable backwards under the thrust exerted by the user's back. The backrest portion 26 can also be fixed relative to the seat portion 24 and elastically deformable in order to tilt backwards under the user's thrust.

In any case, the seat-backrest assembly 14 forms an autonomous constructive element borne by the fixed support structure 12. Consequently, the seat and the backrest are not connected to the support structure 12 separately from each other. On the contrary, the seat and the backrest are mutually connected in fixed or articulated fashion and they form a constructive assembly 14 which is connected to the support structure 12 in the manner described below.

Figure 3:
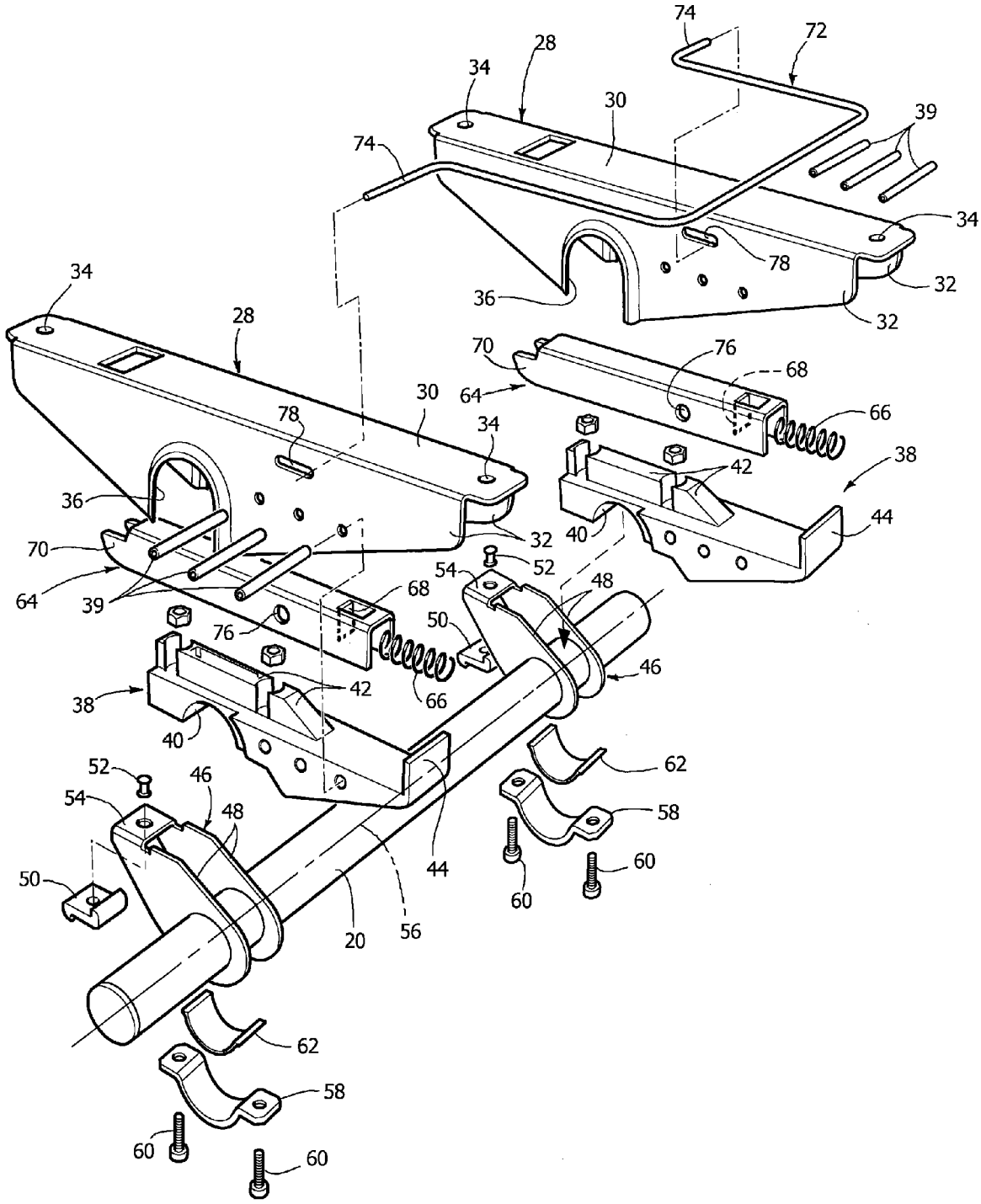
FIG. 3 is an exploded perspective view of the part indicated by the arrow in FIG. 2.

With reference to FIGS. 1 through 3, the seat-backrest assembly 14 comprises two support flanges 28 fastened on the lower side of the seat portion 24. As shown in greater detail in FIG. 3, each support flange 28 is preferably constituted by a metal plate element having a cross section with reversed U shape with a flat upper wall 30 and two mutually parallel lateral walls 32. The lateral walls 32 of each support flange 28 are provided with respective openings 36 with reversed U shape. Each upper wall 30 is provided with holes 34 for fastening, e.g. by means of screws, the support flange 28 to the seat-backrest assembly 14.

With reference to FIG. 3, each support flange 28 bears an articulation element 38 housed between the lateral walls 32 of the support flange 28. Each articulation element 38 is fastened to the respective support flange 28, e.g. by means of a plurality of pivot pins 39 that are inserted through aligned holes of the lateral walls 32 and of the articulation element 38. Each articulation element 38 has a semi-cylindrical articulation seat 40 and has guiding formations 42 on its upper surface. Each articulation element 38 is also provided at its front end with an upwardly turned tab 44.

Also with reference to FIG. 3, the cross member 20 of the fixed support structure 12 bears two stop elements 46, fixed relative to the cross member 20. Each stop element 46 can be formed, for example, by a bent piece of metal plate provided with two parallel walls 48 with aligned holes into which is inserted the cross member 20. The stop elements 46 can be fastened to the cross member 20 for example by welding. Each stop element 46 can be provided with a block 50 fastened, e.g. by means of a rivet 52, to a bridge portion 54 that extends between the parallel walls 48.

Also with reference to FIG. 3, each support flange 28 is connected in articulated fashion to the cross member 20. In particular, each support flange 28 with the respective articulation element 38 is free to rotate relative to the cross member 20 around a transverse horizontal axis 56 coinciding with the longitudinal axis of the cross member 20. Said articulation element 38 is positioned between the two parallel walls 48 of the respective fastening member 46. The articulated connection of the support flange 28 relative to the cross member 20 is completed by means of an Ω shaped element 58 fastened, e.g. by means of screws 60, to the respective articulation element 38. A half-shell 62 made of material with low friction coefficient can be positioned between the Ω shaped element 58 and the outer surface of the cross member 20.

It will be understood that the seat-backrest 14, being fastened to the two support flanges 28, can oscillate around the transverse axis 56. The oscillating motion of the seat-backrest assembly 14 relative to the fixed base structure 12 has two stop positions. The first stop position is defined by the abutment between the support flanges 28 and the stop elements 46. More specifically, said abutment is defined by the contact position between the upper planar surface 30 of the support flanges 28 with the bridge elements 54 of the stop elements 46. This first end stop position corresponds to the position of normal use of the chair.

A second stop position is represented by the condition in which the front part of the seat portion 24 abuts against the front legs 16. In this second stop position, the seat-backrest assembly 14 is inclined forwards, with the seat portion 24 inclined downwards. It should be noted that, to avoid interference during the forward tilting of the seat-backrest assembly 14, the support flanges 28 are moved in the transverse direction towards the interior relative to the front legs 16.

The seat-backrest assembly 14 is provided with a locking device to lock the seat-backrest assembly 14 in the position of normal use shown in FIGS. 1 and 2. With reference to FIG. 3, the locking device comprises two cursors 64, each of which is slidable in orthogonal direction relative to the axis of articulation 56. Each cursor 64 is preferably constituted by bent metal plate and its cross section is substantially shaped a reversed U. Each cursor 64 is positioned between the articulation element 38 and the respective support flange 28 and it slidably engages the guiding formations 42 of the articulation member 38. A helical compression spring 66 is positioned between the tab bent towards the side 44 of the articulation element 38 and a front wall 68 of the cursor 64. The helical spring 66 tends to thrust the respective cursor 64 towards a blocking position. Each cursor 64 has at its rear end an engagement formation 70 with a rounded lower surface. The engagement formation 70 is destined to engage the block 50 of a respective stop member 46. The two cursors 64 are fastened to the ends of an unlocking lever 72, preferably constituted by a metal rod bent into a Ω shape. With reference to FIG. 3, the ends 74 of the unlocking lever 72 are inserted into transverse holes 76 of the cursors 64. The ends 74 of the unlocking lever 72 also slidably engage slots 78 formed in the lateral walls 32 of the support flanges 28.

Figure 4:
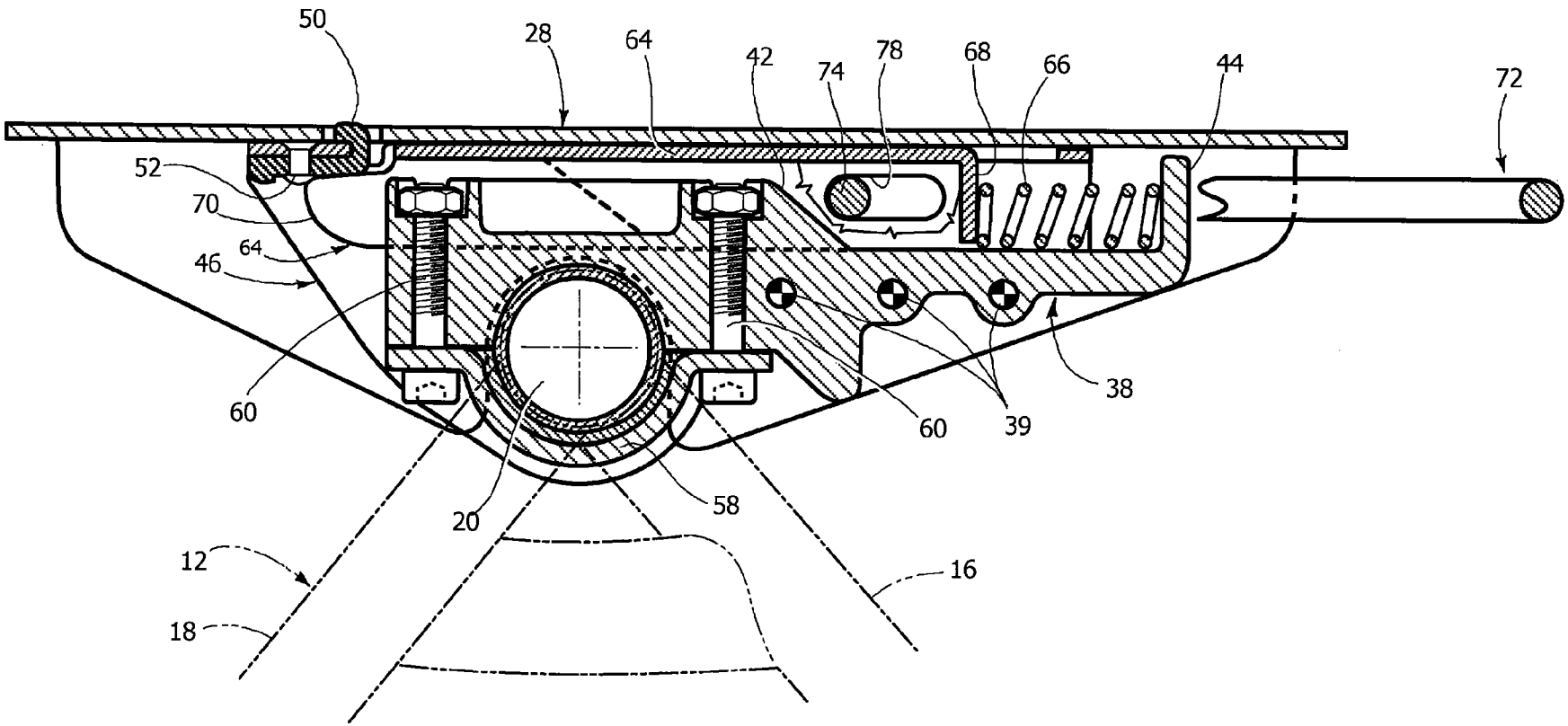
FIG. 4 is a section according to the line IV-IV of FIG. 2, FIGS. 5 and 6 are sections similar to FIG. 4 showing the steps of unlocking and forward swivelling the seat-backrest assembly.
Figure 5:
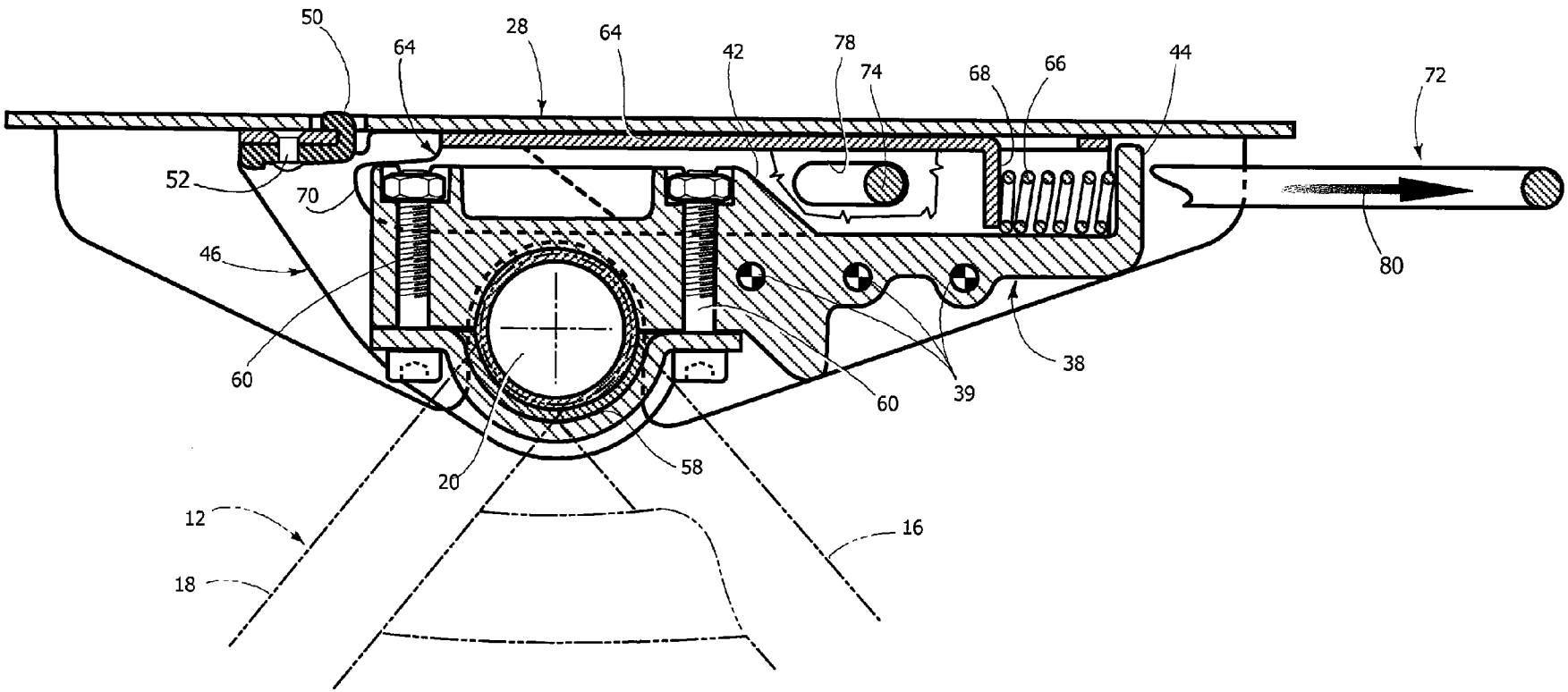
Figure 6:
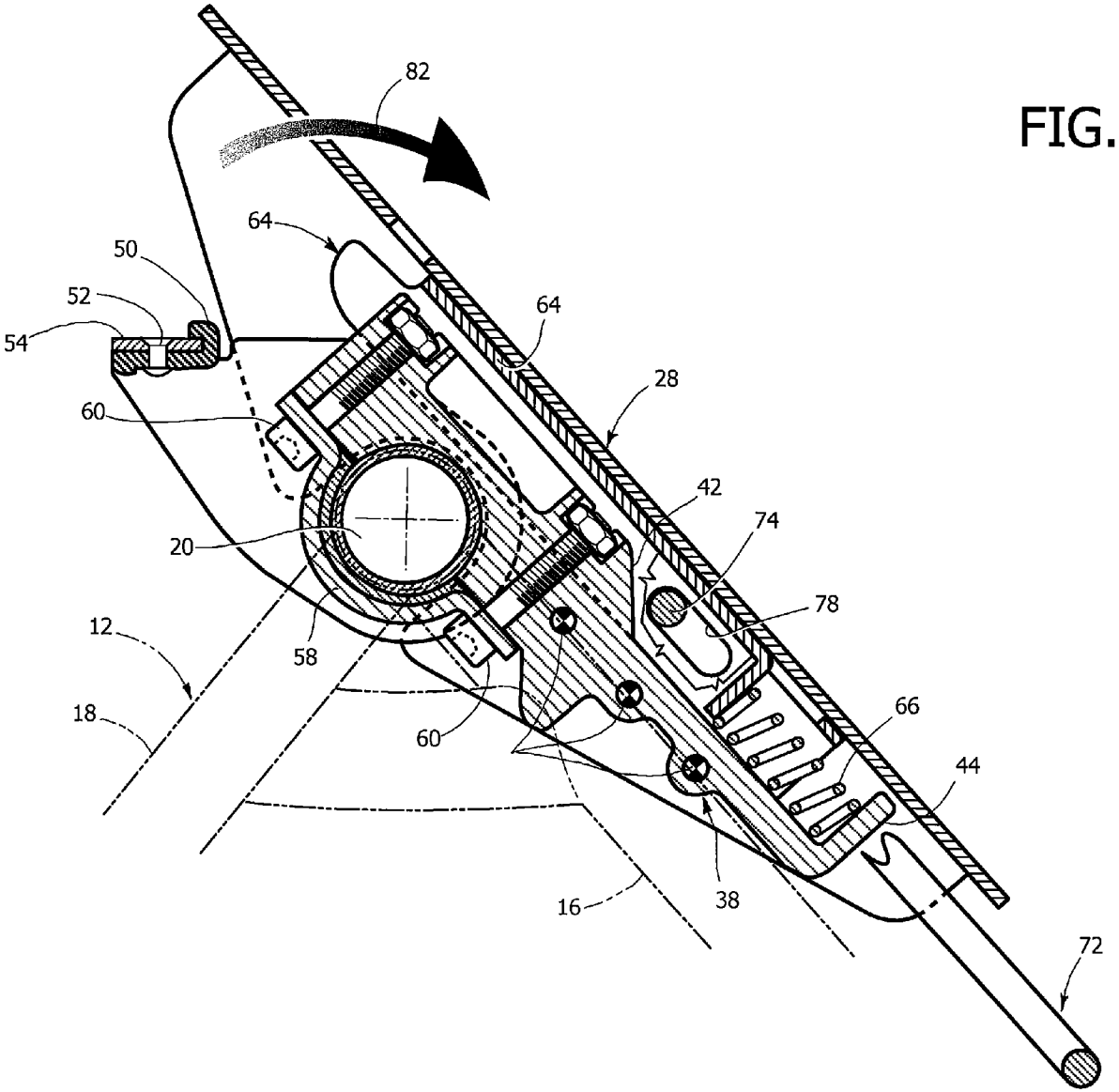

With reference to FIGS. 4, 5 and 6, the operation of the locking device is as follows. In the position shown in FIG. 4, the engagement formations 70 of the cursors 64 engage the lower surface of the blocks 50 of the arresting elements 46. In this position, the seat-backrest assembly 14 is locked in the position of normal use because the abutment between the arresting formations 70 of the cursors 64 and the arresting elements 46 prevents the forward rotation of the seat-backrest assembly 14.

With reference to FIG. 5, when the unlocking lever 72 is pulled forward in the direction indicated by the arrow 80, the cursors 64 are moved forward against the thrust of the springs 66. It can be noted that in the position of FIG. 5 the engagement formations 70 of the cursors 64 are disengaged from the blocks 50 of the arresting members 46.

After disengaging the cursors 64, the seat-backrest assembly 14 is free to rotate forward as indicated by the arrow 82 in FIG. 6. As indicated previously, the forward rotation of seat-backrest assembly 14 is delimited by the abutment condition between the front end of the seat with the legs 16.

To bring the seat-backrest assembly 14 back to the condition of normal use, it is sufficient to rotate upwards the seat-backrest assembly 14. The rounded shape of the engagement formations 70 of the cursors 74 causes the cursors 14 automatically to engage the locking elements 46 when the seat-backrest assembly 14 reaches the position of normal use.

Figure 7:
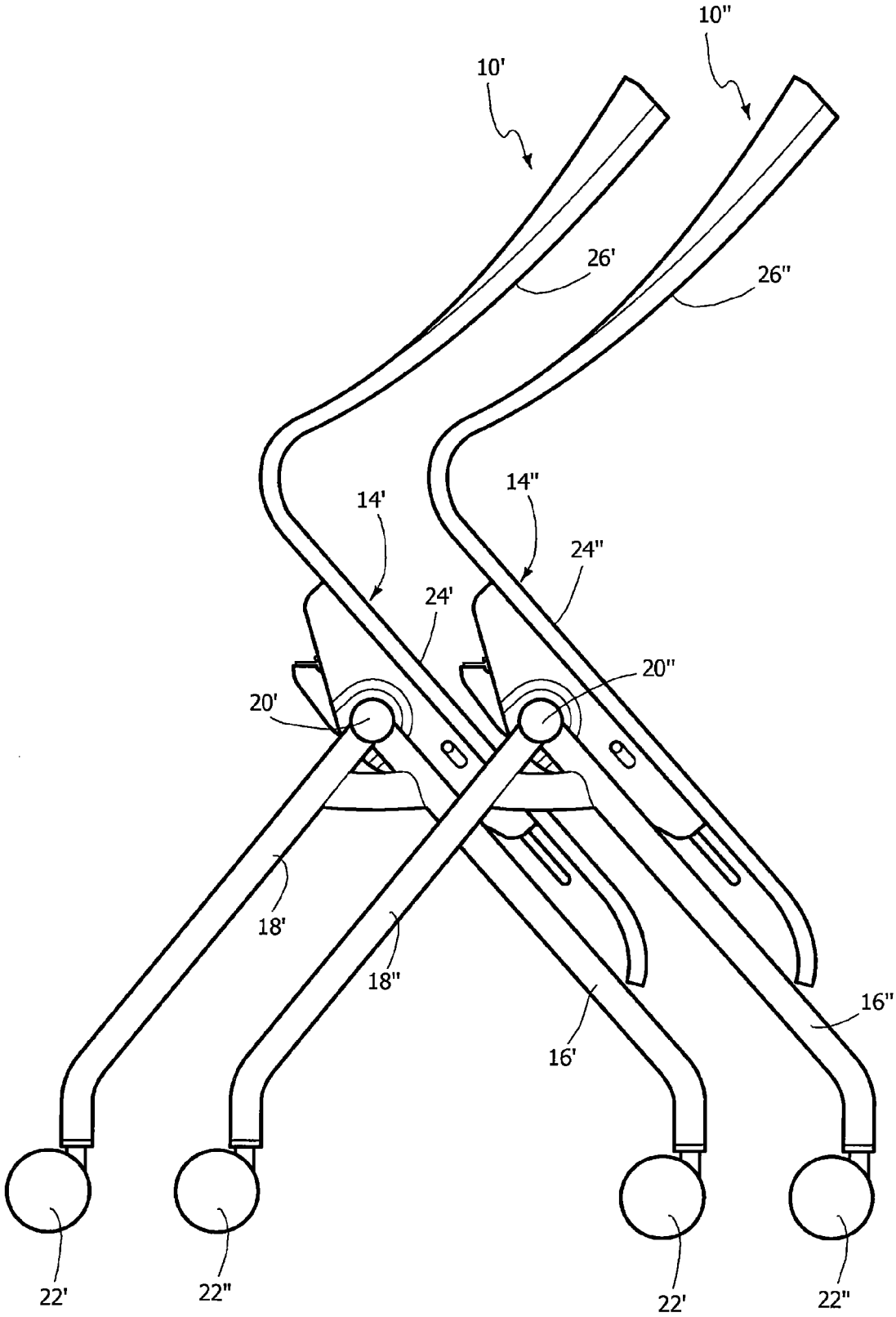
FIG. 7 is a lateral view showing two chairs according to the present invention, nested together.

The forward tilting of the seat-backrest assembly 14 enables to nest in the horizontal direction several identical chairs, with a high degree of mutual co-penetration. FIG. 7 shows two chairs 10', 10" according to the present invention in mutually nested position. In FIG. 7, the reference numbers with an apex refer to a first chair and the reference numbers with two apexes refer to a second chair. As can be noted, in the nested position, the front legs 16' of the first chair 10' are positioned between the rear legs 18" of the second chair 10". The front legs 16' of the first chair 10' extend underneath the front legs 16" of the second chair 10". The seat portion 24' of the first chair 10' is situated below and behind with respect to the seat portion 24" of the second chair 10". The backrest portion 26' of the first chair 10' is positioned above and behind relative to the backrest portion 26" of the second chair 10". This manner of nesting between the chairs enables the optimal exploitation of space when the chairs are in stowage position.

While the foregoing is directed to embodiments of the present invention, other and further embodiments of the invention may be devised without departing from the basic scope thereof, and the scope thereof is determined by the claims that follow.

The invention claimed is:

1. Chair comprising:

a fixed base structure comprising two front legs and two rear legs mutually connected by a cross member, in which the front legs and the rear legs are mutually offset in such a way that the front legs of a first chair can be inserted between the rear legs of a second chair identical to the first, and a seat-backrest assembly borne by the support structure, wherein the seat-backrest assembly is rotatable around said cross member between a position of use and a position of stowage, in which in the position of stowage the seat-backrest assembly is rotated forwards relative to the position of use, said seat-backrest assembly comprises two support flanges each of which bears an articulation element that rotatably engages the cross member and each support flange bears a respective locking cursor elastically thrust towards a locking position, wherein the seat-backrest assembly further comprising an unlocking lever able to be operated manually to bring said cursors towards an unlocking position.

2. Chair as claimed in claim 1, wherein the seat-backrest assembly is mounted rotatable around a horizontal transverse axis coinciding with the longitudinal axis of said cross member.

3. Chair as claimed in claim 2, wherein the fixed support structure defines two stop positions of the seat-backrest assembly corresponding, respectively, to the position of use and to the position of stowage.

4. Chair as claimed in claim 3, further comprising a locking device for locking the seat-backrest assembly in the position of use.

5. Chair as claimed in claim 1, wherein the seat-backrest assembly comprises a seat portion and a backrest portion and forms an autonomous constructive unit with respect to said fixed base structure.

6. Chair as claimed in claim 1, wherein in a position in which a first chair and a second chair are mutually nested horizontally the seat portion of the first chair extends below and behind relative to the seat portion of the second chair and the backrest portion of the first chair extends above and behind relative to the backrest portion of the second chair.

7. A Chair comprising:

a fixed base structure having two front legs and two rear legs mutually connected by a cross member, wherein the front legs and the rear legs are mutually offset in such a way that the front legs of a first chair can be inserted between the rear legs of a second chair wherein the second chair is identical to the first chair, and a seat-backrest assembly rotatably coupled to the fixed base structure, wherein the seat-backrest assembly is rotatable around the cross member between a position of use and a position of stowage, in which in the position of stowage the seat-backrest assembly is rotated forwards relative to the position of use;

a locking member configured to lock the seat-backrest assembly in the stowage position; and a manual unlocking lever configured to release the seat-backrest assembly from the stowage position.

8. The chair of claim 7, further comprising two support flanges configured to couple the seat-backrest assembly to the fixed base structure.

9. The chair of claim 8, wherein the locking member further comprises an articulation element coupled to at least one of the support flanges, wherein the articulation element rotatably engages the cross member.

10. The chair of claim 8, wherein the at least one of the support flanges further comprises a respective locking cursor configured to elastically thrust towards a locking position.

11. The chair of claim 10, wherein the manual unlocking lever is configured to move the cursor toward the unlocking position.

* * * * *